United States Patent [19]

Friedman et al.

[11] 4,452,709

[45] Jun. 5, 1984

[54] ANTISTATIC COMPOSITION

[75] Inventors: Lester A. Friedman, Atlanta; Cecil D. Kwong, Decatur; James D. Faulkner, Atlanta, all of Ga.

[73] Assignee: Lester Laboratories, Inc., Atlanta, Ga.

[21] Appl. No.: 310,352

[22] Filed: Oct. 9, 1981

[51] Int. Cl.[3] ..... D06M 13/32; H01B 1/12

[52] U.S. Cl. ..... 252/8.9; 252/500; 252/518

[58] Field of Search ..... 252/8.9, 135, 136, 500, 252/518

[56] References Cited

U.S. PATENT DOCUMENTS

| | | | |
|---|---|---|---|
| 4,049,558 | 9/1977 | Rasmussen | 252/135 |
| 4,118,327 | 10/1978 | Seugnet | 252/8.9 |
| 4,213,867 | 7/1980 | Cukier et al. | 252/8.9 |
| 4,297,407 | 10/1981 | Manca | 252/8.9 |

FOREIGN PATENT DOCUMENTS

| | | | |
|---|---|---|---|
| 52-53097 | 4/1977 | Japan | 252/8.9 |

*Primary Examiner*—Maria Parrish

*Attorney, Agent, or Firm*—Beveridge, DeGrandi & Kline

[57] ABSTRACT

An antistatic composition is provided for improving the conductivity of a wide variety of substrates. The composition comprises an aqueous solution containing (a) an anionic organic phosphate surfactant of the formula

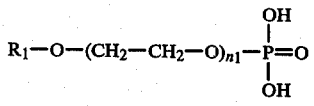

wherein $R_1$ is selected from the group consisting of

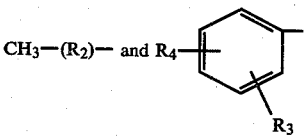

wherein —($R_2$)— is selected from the group consisting of branched and linear alkylene having 4 to 18 carbon atoms, and wherin $R_3$ and $R_4$ are the same or different and are selected from the group consisting of hydrogen and branched and linear alkyl of 4 to 12 carbon atoms, and wherein $n_1$ is an integer of 4 to 14, and (b) disodium phosphate, wherein the weight ratio of ingredient (a) to ingredient (b) is from about 1:20 to about 20:1.

28 Claims, No Drawings

ANTISTATIC COMPOSITION

BACKGROUND OF THE INVENTION

The present invention relates to an antistatic composition which is effective to increase electrical conductivity of a wide variety of substrates, and this increase in conductivity enables the removal of static charges on such substrates. The invention also relates to a method for increasing the electrical conductivity of such substrates.

Static electricity is the electricity of stationary charges, however produced. A wide variety of substrates have a tendency to acquire and retain electrostatic charges, and the static electricity which results can be bothersome and, in certain circumstances, dangerous.

In the case of carpets, a person walking across a carpet may acquire a charge of static electricity, and the subsequent discharge of this electricity from the individual to a grounded object can be quite disturbing.

In various fabrics, films and sheets, static electricity can engender considerable difficulties in the handling of such articles by causing different portions of the same article, or different articles, to cling together. Such clinging can cause difficulty in the processing of such articles on automatic equipment, and such clinging also can interfere with the final utility of the article. In addition, static electricity can cause many types of substrates to attract dust and dirt, thereby hastening the soiling of such substrates. In certain cases, as with photographic film, the attraction of dust and dirt can be especially detrimental.

In environments where vapors having low flash points may be present, the importance of antistatic compositions can be especially appreciated. Such environments include hospital operating rooms and laboratories, and the present invention can serve to eliminate spark hazards which might otherwise occur because of the retention of static charges in flooring material, such as carpets and vinyl flooring.

There exists a need in the art for an antistatic agent, which can be applied to a wide variety of substrates, including but not limited to carpets, in order to increase the electrical conductivity of the substrates to thereby decrease the deleterious effects of static electrical charges which otherwise may have been present in the substrate.

SUMMARY OF THE INVENTION

In accordance with the present invention, an antistatic composition is provided for application to various substrates. The composition comprises an aqueous solution containing:

(a) an anionic organic phosphate surfactant of the formula $$R_1-O-(CH_2-CH_2-O)_{n1}-\overset{\overset{OH}{|}}{\underset{\underset{OH}{|}}{P}}=O \text{ where } R_1 \text{ is } CH_3-(R_2)-\text{or}$$

-continued

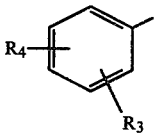

where —$(R_2)$— is branched or preferably linear alkylene, of 4 to 18 carbon atoms, preferably —$(CH_2)_{n2}$— where $n_2$ is an integer of 4 to 18, preferably 6 to 16, and where $R_3$ and $R_4$ are the same or different and are H or branched or linear alkyl of 4 to 12 carbon atoms, and where $n_1$ is an integer of 4 to 14, preferably 4 to 12, and (b) disodium phosphate, wherein the weight ratio of ingredient (a) to ingredient (b) is from 1:20 to 20:1.

DETAILED DESCRIPTION OF THE INVENTION

In accordance with the present invention, it surprisingly has been found that the electrical conductivity of a wide variety of substrates can be increased, and the occurrence of static electricity correspondingly decreased, by application of the presently claimed antistatic composition. Broadly speaking, the invention involves the use of an anionic organic phosphate surfactant with a certain inorganic salt.

The anionic organic phosphate surfactant has the formula $$R_1-O-(CH_2-CH_2-O)_{n1}-\overset{\overset{OH}{|}}{\underset{\underset{OH}{|}}{P}}=O \text{ where } R_1 \text{ is } CH_3-(R_2)-\text{or}$$

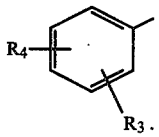

In this formula, —$(R_2)$— is a branched or linear group of 4 to 18 carbon atoms. Preferably, —$(R_2)$— is —$(CH_2)_{n2}$—, i.e., a linear alkylene group, where $n_2$ is an integer of 4 to 18, preferably 6 to 16. The substituents $R_3$ and $R_4$ are the same or different and are hydrogen or branched or linear alkyl groups of 4 to 12 carbon atoms. In the foregoing generic formula, $n_1$ is an integer of 4 to 14, preferably 4 to 12. It is to be understood that the values of $n_1$ and $n_2$ need not be the same in the surfactant employed in the composition of this invention. —$(R_2)$— can be either a saturated or unsaturated group.

When the $R_1$ group of the anionic organic phosphate surfactant contains an aromatic group, $R_1$ will typically be

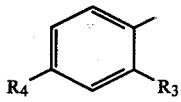

where $R_3$ is hydrogen and $R_4$ is $C_9$ alkyl.

Among the commercially available anionic organic phosphate surfactants coming within the scope of this invention are free acids of complex phosphate esters. In a preferred embodiment, GAFAC RA-600 is used in an aqueous solution with disodium phosphate. GAFAC RA-600 is available from GAF Corp., New York, N.Y. It is to be understood that the present invention is not to be limited in any way to these particular surfactants, but that, instead, the scope of the present invention includes all surfactants coming within the definition recited above.

The inorganic salt of the present invention is disodium phosphate. Surprisingly, it has been discovered that an aqueous solution containing the above-identified surfactant and this inorganic salt results in a conductivity which is much greater than could be expected from an increased conductivity resulting from either of the surfactant or salt ingredient when used alone.

The weight ratio of the surfactant to disodium phosphate can be from about 1:20 to about 20:1. Preferably, the weight ratio will be from about 1:10 to about 10:1. In an especially preferred embodiment, the weight ratio of surfactant to disodium phosphate is about 2:1 to about 3:1.

In the composition of this invention, the surfactant and inorganic salt are contained in an aqueous solution. The surfactant is water-soluble to the extent of at least 10 weight percent at 20° C. The surfactant will be present in the aqueous solution in an amount of from 0.25% by weight up to the solubility limit for the surfactant in the aqueous solution. Preferably, the surfactant will be present in an amount of about 7.5% by weight.

The amount of disodium phosphate in the aqueous solution is at least 0.125% by weight. Preferably, the salt will be present in an amount of about 2.5% by weight. Generally, the combined amounts of surfactant and disodium phosphate in a composition according to the invention will not exceed about 10% by weight.

The water used to form the aqueous solution of the claimed composition can be tap water. However, it will be readily apparent that demineralized water can also be employed.

As has been indicated above, the present invention has wide applications in several fields. In order to achieve an increased electrical conductivity, the composition of the present invention can be advantageously applied to films, fibers, yarns, fabrics, carpets, webs, non-woven textiles, flooring materials, garments, blankets, upholstery, drapes, photographic film, phonograph records, magnetic tapes and the like. Application of the present composition can be made advantageously to all types of carpets and textiles, such as those manufactured from natural fibers, such as wool and cotton, and synthetic fibers, such as acetates, acrylics, nylons, polyesters, and polyolefins, such as polyethylene and polypropylene. Of course, this list of substrates is exemplary and not all-inclusive.

In addition to the above-mentioned substrates, polymer products, including styrofoam cups, can be made more easily manipulatable by treatment with the novel composition.

The composition of this invention can be applied to a substrate in a number of ways. Thus, application can be by, for example, dipping, spraying, rolling or brushing. In a preferred embodiment, application of the claimed composition is effected by spraying onto the substrate.

In another embodiment, the composition can be applied to a substrate by first applying the composition to machine parts that contact the substrate to be treated. In one of numerous possible examples, a capstan can receive an application of the composition, and the static electricity can be prevented or reduced in fibers and yarns which might pass over the capstan.

The amount of the antistatic composition of this invention to be applied to a particular substrate is an amount sufficient to increase the electrical conductivity of the substrate, to thus enable the prevention, lessening or elimination of static charge on the treated substrate. As an example, when a fabric is treated with the composition of this invention, about 0.01 to about 10 weight percent of a 10 weight percent solution, based on the weight of the fabric, is sufficient. Preferably, about 0.1 to about 1 weight percent of a 10 weight percent solution is applied to a fabric.

After application of the composition, the substrate is dried so that the water will be caused to evaporate. Substances that will form minimum boiling azeotropes with water can be added to the aqueous solution of this invention to increase the rate of evaporation of water from the treated substrate. Typically, an effective amount of a volatile, lower alkyl alcohol, such as ethanol, can be employed for this purpose.

It is also within the scope of the present invention to apply a mixture of surfactant and disodium phosphate to a moist substrate, wherein the moisture of the substrate would assist in the absorption of the composition by the substrate.

In order to more clearly set forth the nature of the present invention, the following examples are provided. All parts, proportions, ratios and percentages are by weight unless otherwise indicated.

EXAMPLE I

Example I consisted of a series of Runs wherein the conductivity of sized acetate threads, treated with an aqueous solution containing only 1.0% by weight of GAFAC RA-600 (Runs 1 to 5), was compared with the conductivity of threads treated with a composition of the present invention. In Runs 6 through 9, the conductivity of threads treated with an aqueous solution of 0.5% by weight disodium phosphate (DSP) and 1.0% by weight of GAFAC RA-600 was tested. In all of the Runs, the fibers were soaked in the compositions for 10–15 seconds, followed by evaporation of the water in the composition.

For comparison, Run 10 was made to measure the conductivity of an untreated fiber. A sized acetate fiber was washed with water and dried.

A current source was connected to one probe and a Keithley electrometer was connected to a second probe. The probes were placed 15 cm apart, and the thread to be tested was extended linearly between the two probes. An arbitrary amount of current was generated by the current source and relative conductance of the thread was measured on the electrometer. The maximum current which could be generated by the current source through a piece of copper wire was about $2\times10^{-4}$ amps.

Table I shows the results of the testing, wherein relative conductivities are set forth in amps.

TABLE I

| Run No. | Ingredients of Aqueous Solution | Conductivity (amps) |
|---|---|---|
| 1 | GAFAC RA-600 | $3.5 \times 10^{-8}$ |
| 2 | GAFAC RA-600 | $2.4 \times 10^{-8}$ |
| 3 | GAFAC RA-600 | $4.3 \times 10^{-8}$ |
| 4 | GAFAC RA-600 | $4.5 \times 10^{-8}$ |
| 5 | GAFAC RA-600 | $1.9 \times 10^{-8}$ |
| 6 | GAFAC RA-600 and DSP | $6.0 \times 10^{-7}$ |
| 7 | GAFAC RA-600 and DSP | $5.0 \times 10^{-7}$ |
| 8 | GAFAC RA-600 and DSP | $4.5 \times 10^{-7}$ |
| 9 | GAFAC RA-600 and DSP | $3.1 \times 10^{-7}$ |

TABLE I-continued

| Run No. | Ingredients of Aqueous Solution | Conductivity (amps) |
|---|---|---|
| 10 | Water Wash Only | $<1.0 \times 10^{-12}$ |

EXAMPLE II

An aqueous solution is prepared by mixing the following ingredients (given in weight percent):

90% tap water 7.5% free acid of a complex phosphate ester (GAFAC RA-600)

2.5% disodium phosphate.

This combination of ingredients results in a most preferred embodiment. The composition of this Example can be advantageously applied to polyester, polyacetate, nylon and cotton substrates.

As can be seen from the foregoing Examples, the present invention provides an improved conductivity which is significantly greater than that which could have possibly been expected by those of ordinary skill in the art. The foregoing Examples clearly reveal the importance of applicants' discovery, whereby disodium phosphate is combined in aqueous solution with the described surfactant for use as an antistatic agent.

What is claimed is:

1. An antistatic composition comprising an aqueous solution containing (a) an anionic organic phosphate surfactant of the formula

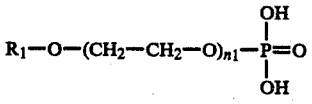

wherein $R_1$ is selected from the group consisting of

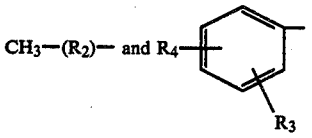

wherein —($R_2$)— is selected from the group consisting of saturated and unsaturated branched and linear groups having 4 to 18 carbon atoms, and wherein $R_3$ and $R_4$ are the same or different and are selected from the group consisting of hydrogen and branched and linear alkyl of 4 to 12 carbon atoms, and wherein $n_1$ is an integer of 4 to 14, and (b) disodium phosphate, wherein the weight ratio of ingredient (a) to ingredient (b) is from about 1:20 to about 20:1.

2. The composition of claim 1, wherein —($R_2$)— is —$(CH_2)n_2$—, where $n_2$ is an integer of 4 to 18.

3. The composition of claim 2, wherein $n_2$ is an integer of 6 to 16.

4. The composition of claim 1, wherein $R_1$ is

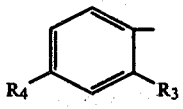

wherein $R_3$ is hydrogen and $R_4$ is $C_9$ alkyl.

5. The composition of claim 1, wherein $n_1$ is an integer of 4 to 12.

6. The composition of claim 1, wherein said surfactant is water-soluble to the extent of at least 10 weight percent at 20° C.

7. The composition of claim 1, wherein the weight ratio of said surfactant to said disodium phosphate is from about 1:10 to about 10:1.

8. The composition of claim 1, wherein the weight ratio of said surfactant to said disodium phosphate is about 2:1 to about 3:1.

9. The composition of claim 1, wherein said surfactant is present in an amount of from about 0.25% by weight up to the solubility limit for said surfactant in said aqueous solution.

10. The composition of claim 1, wherein said surfactant is present in an amount of about 7.5% by weight.

11. The composition of claim 1, wherein said disodium phosphate is present in an amount of at least about 0.125% by weight.

12. The composition of claim 1, wherein said disodium phosphate is present in an amount of about 2.5% by weight.

13. The composition of claim 1, wherein the total amount of said surfactant and said disodium phosphate does not exceed about 10% by weight.

14. The composition of claim 2, wherein said surfactant is present in an amount of about 7.5% by weight, said disodium phosphate is present in an amount of about 2.5% by weight, and water is present in the amount of about 90% by weight.

15. The composition of claim 1, further comprising a substance that will form a minimum boiling azeotrope with water.

16. The composition of claim 15, wherein said substance is a volatile lower alkyl alcohol.

17. The composition of claim 16, wherein said alcohol is ethanol.

18. A method of increasing the electrical conductivity of a substrate comprising the step of applying the composition of claim 1 to said substrate.

19. The method of claim 18, wherein said substrate is an acetate fiber and said applying step comprises applying said composition to said acetate fiber.

20. The method of claim 18, wherein said applying step comprises spraying said composition on said substrate.

21. The method of claim 18, further comprising the step of drying said composition after said applying step.

22. The method of claim 18, wherein said composition is applied in an amount of 0.01 weight percent of a 10 weight percent solution, based on the substrate's weight.

23. The method of claim 22, wherein said amount is 0.1 to 1.0 weight percent of a 10 weight percent solution.

24. A method of increasing the electrical conductivity of a carpet, comprising the step of applying an amount of the composition of claim 1 or claim 15 which is effective to increase the electrical conductivity of said carpet.

25. The substrate produced by the method of claim 18.

26. An antistatic composition comprising an aqueous solution containing (a) an anionic organic phosphate surfactant of the formula

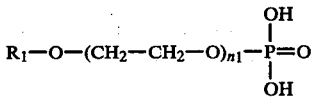

wherein $R_1$ is selected from the group consisting of

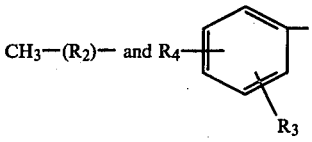

wherein —($R_2$)— is selected from the group consisting of saturated and unsaturated branched and linear groups having 4 to 18 carbon atoms, and wherein $R_3$ and $R_4$ are the same or different and are selected from the group consisting of hydrogen and branched and linear alkyl of 4 to 12 carbon atoms, and wherein $n_1$ is an integer of 4 to 14, and (b) disodium phosphate, wherein the weight ratio of ingredient (a) to ingredient (b) is from about 1:10 to about 10:1.

27. The composition of claim 26 wherein the weight ratio of said surfactant to said disodium phosphate is about 2:1 to about 3:1.

28. The composition of claim 26 wherein said surfactant is present in an amount of about 7.5% by weight and said disodium phosphate is present in an amount of about 2.5% by weight.

* * * * *